US005472201A

United States Patent [19]

Aizawa et al.

[11] Patent Number: 5,472,201

[45] Date of Patent: Dec. 5, 1995

[54] GOLF CLUB HEAD AND STRIKING FACE

[75] Inventors: Yuichi Aizawa; Mahito Kimura, both of Tokyo, Japan

[73] Assignee: Daiwa Golf Co., Ltd., Tokyo, Japan

[21] Appl. No.: 261,127

[22] Filed: Jun. 14, 1994

[30] Foreign Application Priority Data

Jun. 21, 1993 [JP] Japan ..... 5-033357 U

[51] Int. Cl.[6] ..... A63B 53/04

[52] U.S. Cl. ..... 273/167 J; 273/78

[58] Field of Search ..... 273/78, 173, 167 H, 273/167 J, 167 R

[56] References Cited

U.S. PATENT DOCUMENTS

| | | | |
|---|---|---|---|
| 708,575 | 9/1902 | Mules | 273/78 |
| 3,817,522 | 6/1974 | Simmons | 273/78 |
| 4,740,345 | 4/1988 | Nagasaki et al. | 273/173 |
| 4,928,972 | 5/1990 | Nagasaki et al. | 273/78 |
| 5,198,062 | 3/1993 | Chen | 273/167 J |

FOREIGN PATENT DOCUMENTS

| | | |
|---|---|---|
| 59-16670 | 2/1984 | Japan . |
| 61-21570 | 2/1986 | Japan . |
| 61-240978 | 10/1986 | Japan . |
| 4-46777 | 11/1992 | Japan . |

*Primary Examiner*—V. Millin
*Assistant Examiner*—William M. Pierce
*Attorney, Agent, or Firm*—Longacre & White

[57] ABSTRACT

In a golf club head, a head main body formed of metal includes a recessed portion in the face part thereof, a face member formed of a highly elastic synthetic resin material is mounted in the recessed portion, and, at the ball hitting surface side of the face member, there is disposed a protective layer formed of a metal plate which is higher in hardness than the highly elastic synthetic resin material, is equal to or smaller than the head main body in specific gravity, and is smaller in thickness than the face member. The golf club head can prevent the ball hitting surface of the golf club head from being worn without impairing ball carry and ball hitting feeling.

10 Claims, 4 Drawing Sheets

GOLF CLUB HEAD AND STRIKING FACE

BACKGROUND OF THE INVENTION

The present invention relates to a golf club head which prevents its ball hitting surface from being worn without impairing ball carry and ball hitting feeling.

Conventionally, as disclosed in Japanese Utility Model Publication No. 59-16670 of Showa, there is known a golf club head including a face part which is formed of fiber reinforced synthetic resin which is reinforced with non-metal fiber such as carbon, glass or the like and has high elasticity.

In the above golf club head, a hosel part, a sole part, a plate-like core member erected perpendicularly in the sole part and the like are formed integrally and then the fiber reinforced synthetic resin having high elasticity forming a face part is integrally applied to the core member.

According to such golf club including a face part formed of fiber reinforced synthetic resin, the ball carry is increased due to the high restitution of the fiber reinforced synthetic resin. Further, it is well known that, in a heavy metal golf club, because the specific gravity of the fiber reinforced resin is small, its face part is light and thus the gravity depth thereof is deep, so that the ball can be controlled easily.

However, because the highly elastic synthetic resin material is easy to wear due to shocks given when the ball is hit, the ball hitting surface of the face part is worn and sunken for a long period of use.

In view of this, recently, as disclosed in Japanese Utility Model publication No. 4-46777 of Heisei, Japanese Utility Model Publication No. 61-21570 of Showa, or Japanese Patent Publication No. 61-240978 of Showa, there have been proposed various golf club heads in which the ball hitting surface of the face part is reinforced.

In particular, in a golf club head disclosed in Japanese Utility Model Publication No. 4-46777 of Heisei, the core body thereof is composed of a sole part and a hosel part respectively formed of metal, and a face core part disposed integrally on the sole part; and, a highly elastic synthetic resin layer is provided at least in the ball hitting area of the front surface of the face core part except for the sole part, a metal fiber reinforced synthetic resin layer forming a face part is disposed outside the highly elastic synthetic resin layer, and then the both resin layers are united into one body.

Also, in a golf club head disclosed in Japanese Utility Model publication No. 61-21570 of Showa, as shown in FIGS. 7 and 8, an auxiliary face plate 5 is mounted such that it covers substantially the whole areas of a face part 3 of a wooden head main body 1 and a main face plate 9 is fitted into a recessed portion 7 formed in the surface of the auxiliary face plate 5. The main face plate 9 is formed of a material such as a carbon fiber reinforced synthetic resin material having a higher surface hardness than the head main body 1. Also, the auxiliary face plate 5 is formed of a material which is lower in surface hardness than the main face plate 9 but higher than the head main body 1.

Further, in a golf club head disclosed in Japanese Patent Publication No. 61-240978 of Showa, as shown in FIG. 9, a soft layer 13 formed of a rubber elastic member or a resin foaming member is provided at the front surface side of a head main body 11 and a hard layer 15 formed of fiber reinforced resin is provided at the ball hitting surface side of the soft layer 13.

However, even if the outside of the highly elastic synthetic resin layer is reinforced with the metal fiber reinforced resin layer as in the golf club head disclosed in Japanese Utility Model Publication No. 4-46777 of Heisei, the matrix synthetic resin is still easy to wear and, therefore, such reinforcement is not sufficient as means for protecting the ball hitting surface of the golf club head.

Also, since the head main body 1 of the golf club head shown in FIGS. 7 and 8 is formed of wood, when the metal face plates 5, 9 are mounted on the face part of the head, then the face part side of the head is heavy and thus the gravity depth of the head is shallow, which makes it difficult to control the golf club head.

Further, like the golf club head shown in FIG. 9, if the soft layer 13 is used in the face part, then the high restitution of the hard layer cannot be utilized but the feeling of ball hitting can also be impaired.

SUMMARY OF THE INVENTION

The present invention aims at eliminating the drawbacks found in the above-mentioned conventional golf club heads. Accordingly, it is an object of the invention to provide a golf club head which can prevent the ball hitting surface thereof from being worn without imparting ball carry and ball hitting feeling.

In attaining the above object, according to the invention, there is provided a golf club head in which a recessed portion is formed in a face part of a metal head main body, a face member formed of a highly elastic synthetic resin material is mounted in the recessed portion, and, at the ball hitting surface side of the face member, there is provided a protective layer formed of a metal plate which is higher in hardness than the highly elastic resin synthetic resin material, is equal to or smaller than the head main body in specific gravity, and is smaller in thickness than the face member.

In a golf club head according to the invention, since a face member formed of a highly elastic synthetic resin material is provided at the face part side of a head main body of the golf club head, the face part side of the golf club head is light in weight and thus the gravity depth thereof is deep, and also because the protective layer thereof is formed of a metal plate smaller in thickness than the face member, the restitution of the face member cannot be impaired but the protective layer protects the ball hitting surface side of the face member against shocks given when a ball is hit to thereby prevent the face member from being worn.

Besides, since the protective layer has a specific gravity equal to or smaller than the head main body, the protective layer can protect the face member as well as can maintain the deep gravity depth of the head main body.

In case where a plurality of score line grooves are formed on a surface of the metal plate protective layer, it is possible to surely prevent a possibility that the score lines disappear due to the wear of the ball hitting surface. In case where the recessed portion is completely circumscribed by a periphery of said face part and/or the protective layer is provided so as to completely close an open end of the recessed portion, a repulsive energy stored in the face member of the high elastic synthetic resin material can be efficiently and sufficiently transmitted to the protective layer to drive a golf ball further. In case where the protective layer is designed such that it is smaller than the open end of the recessed portion, that is, the protective layer is provided such that a portion of the face member is exposed outside, it is possible to reduce the weight of the face part side of the head main body, so that the center of gravity of the head main body can be located deeper. In case where the protective layer is prevented from contacting with the head main body or the protective layer is completely circumscribed by a portion of the face member, since the face member of the synthetic resin material is interposed between the head main body and the protective layer both formed of metallic material, is possible to prevent an unpleasant vibration, which may occur on the protective layer upon hitting a golf ball, from being directly transmitted to the head main body.

DETAILED DESCRIPTION OF THE PREFERRED EMBODIMENTS

Description will be given hereinbelow in detail of the embodiments of the invention with reference to the accompanying drawings.

Figure 1:
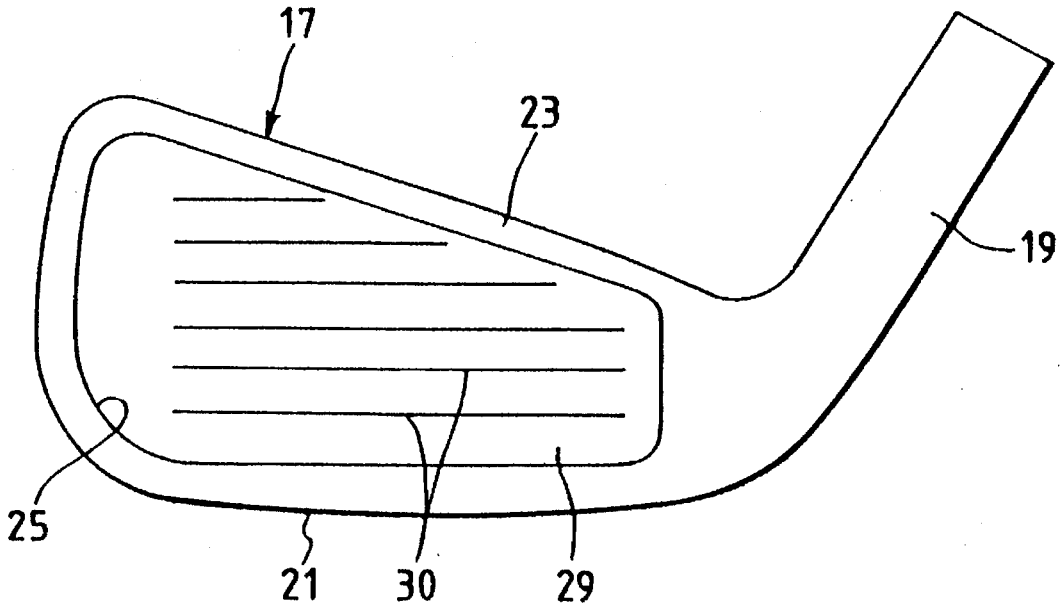
FIG. 1 is a front view of a golf club head according to a first embodiment of the invention.
Figure 2:
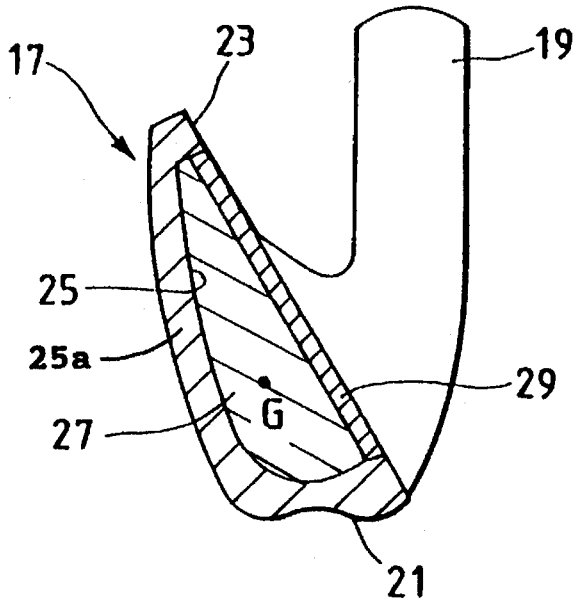
FIG. 2 is a section view of the golf club head shown in FIG. 1.

FIG. 1 is a front view of the golf club head according to a first embodiment of the intention and FIG. 2 is a section view of the above golf club head. In these figures, reference character 17 designates a head main body formed of stainless steel, and the head main body 17 includes a hosel part 19, a sole part 21, and a face part 23 which are formed integrally with one another.

The face part 23 includes a recessed portion 25 which is substantially identical in shape with the face part 23. The recessed portion 25 is circumscribed by a peripheral portion of the face part 23. And, in the recessed portion 25 defined by a rear wall **25*a* there is mounted a face member 27 formed of a fiber reinforced synthetic resin material which is reinforced with non-metallic fiber such as carbon, glass or the like and has high elasticity. Further, a protective layer 29 is mounted flush with the periphery of the face part 23 such that it covers the whole of the ball hitting surface of the face member 27**.

The protective layer 29 is formed of a metal plate which is higher in hardness than the face member 27, is smaller in specific gravity than the head main body 17, and is smaller in thickness than the face member 27. The material of the protective layer 29 includes stainless steel, titanium, aluminum, beryllium, lithium, alloys of these metals, and the like. Also, the protective layer 29 has an outer shape which is substantially identical with the recessed portion 25. Further, the protective layer 29 includes on the surface thereof a plurality of score life grooves 30 which can be used to put spin on a ball.

As described above, according to the present embodiment, since the face member 27 formed of the fiber reinforced synthetic resin material is provided at the side of the head main body 17 where the face part 23 is provided, the face part 23 side of the golf club head becomes light and thus the gravity depth thereof is deep. Further, because the protective layer 29 is formed of the metal plate which is smaller in thickness than the face member, the restitution of the face member 27 cannot be impaired and the protective layer 29 protects the ball hitting side of the face member 27 to thereby prevent the face member 27 from being worn.

Besides, since the protective layer 29 has specific gravity equal to or smaller than the head main body 17, the protective layer 29 can protect the face member 27 as well as can maintain the deep gravity depth of the head main body 17. In FIG. 2, the reference character G designates a center of the gravity of the head main body 17, which is located within the fiber reinforced resin material of the face member 27.

Therefore, if a ball is hit with a golf club having the golf club head according to the present embodiment, then the ball can be easily controlled because the gravity depth thereof is deep, the carry of the ball can be increased due to the high restitution of the face member 27, and the feeling of hitting the ball can be improved. Also, there is eliminated the possibility that the ball hitting surface side of the face member 27 can be worn because of shocks given when the ball is hit. In this manner, according to the present embodiment, the ball hitting surface of the golf club head can be prevented from wearing without impairing the ball carry an ball hitting feeling.

Figure 3:
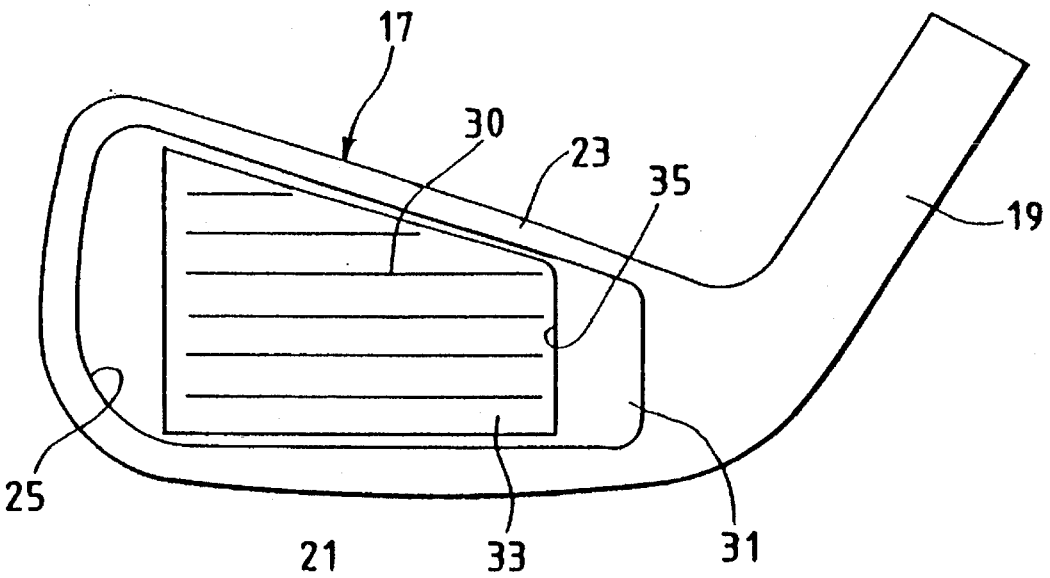
FIG. 3 is a front view of a golf club head according to a second embodiment of the invention.
Figure 4:
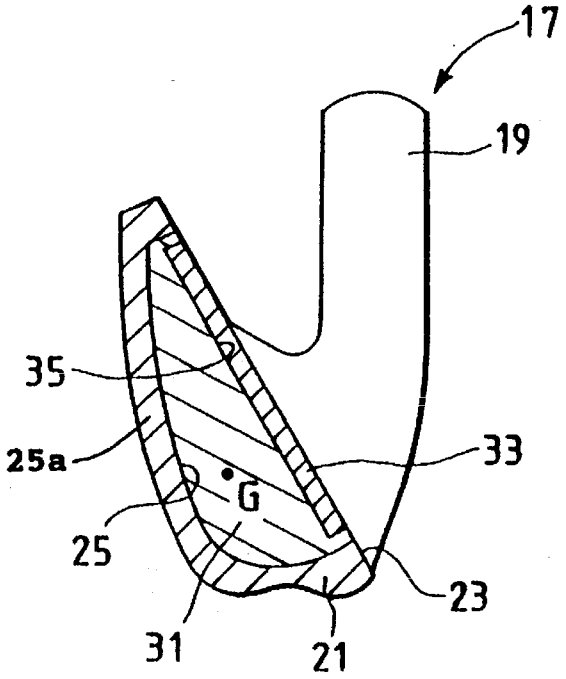
FIG. 4 is a section view of the golf club head shown in FIG. 3.

FIGS. 3 and 4 show a second embodiment of a golf club head according to the invention. In FIGS. 3 and 4, reference character 31 designates a face member which is mounted in a recessed portion 25 formed in a head main body 17 and abuts the rear wall **25*a*. The face member 31 is formed of the same material as the face member 27 in the first embodiment and the ball hitting surface side of the face member 31 is mounted flush with the periphery of the face part 23 of the head main body 17**.

At the ball hitting surface side of the face member 31, there is mounted a protective layer 33 which is formed of the same material as the protective layer 29 in the first embodiment and is smaller in thickness than the face member 27. The protective layer 33 is mounted in a recessed portion 35 formed at the ball hitting surface side of the face member 31 such that it is flush with the ball hitting surface side of the face member 31, and the ball hitting surface side of the face member 31 is in part exposed to the face part 23.

The remaining portions of the second embodiment are similar to those in the first embodiment, the same designations are given to the same parts, and thus the description thereof is omitted here.

Accordingly, in the second embodiment as well, since the face member 31 formed of the fiber reinforced synthetic resin material is provided at the face part 23 side of the head main body 17, the face part 23 side of the golf club head is light and thus the gravity depth thereof is deep. Also, because the protective layer 33 is formed of a metal plate having a smaller thickness than the face member 31, the restitution of the face material 31 is not impaired but the protective layer 33 protects the ball hitting surface side of the face member 31 to thereby prevent the face member 31 from being worn.

Moreover, since the protective layer 33 has specific gravity equal to or smaller than the head main body 17, the protective layer 33 can protect the face member 31 as well as can maintain the deep gravity depth.

Accordingly, if a ball is hit with a golf club having the golf club head according to the present embodiment, then similarly to the first embodiment, since the gravity depth thereof is deep, the ball can be controlled easily, the ball carry can be increased due to the high restitution of the face member 31 and the ball hitting feeling can be improved as well. Further, the face member 31 is prevented from wearing against shocks given when the ball is hit. Therefore, according to the present embodiment as well, the ball hitting surface of the golf club head can be prevented from wearing without impairing the ball carry and ball hitting feeling.

Figure 5:
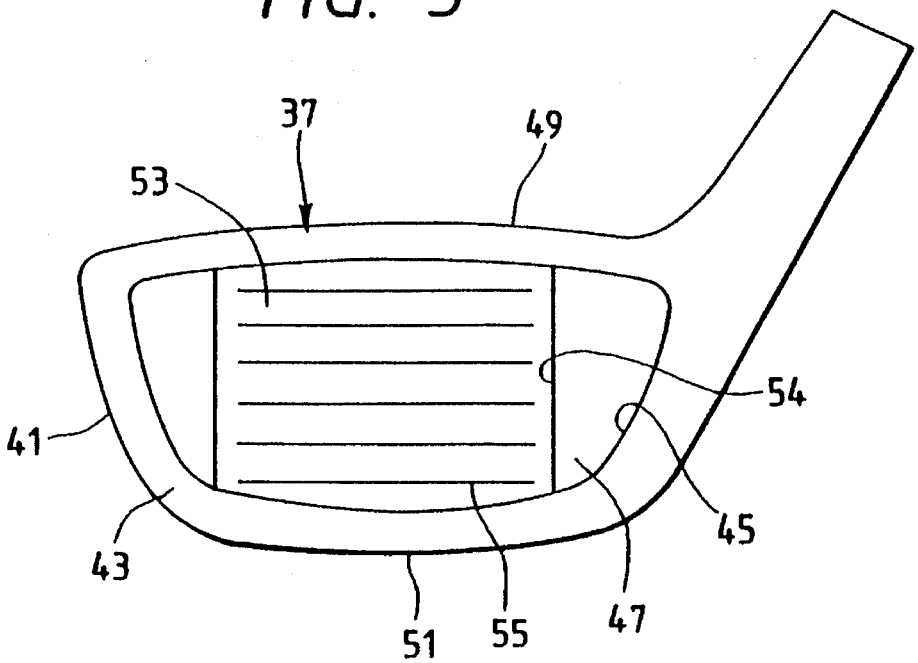
FIG. 5 is a front view of a golf club head according to a third embodiment of the invention.
Figure 6:
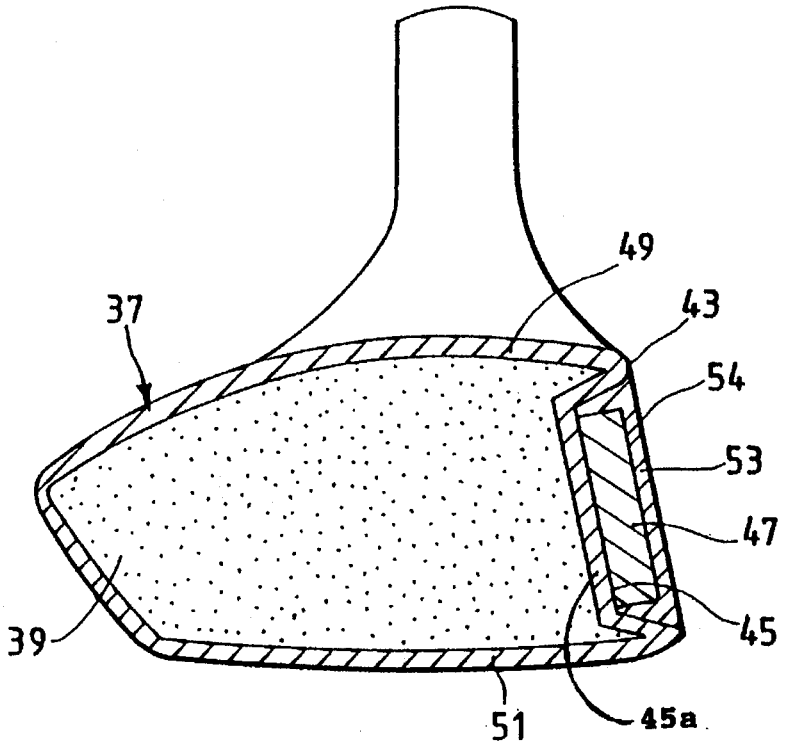
FIG. 6 is a section view of the golf club head shown in FIG. 5.
Figure 7:
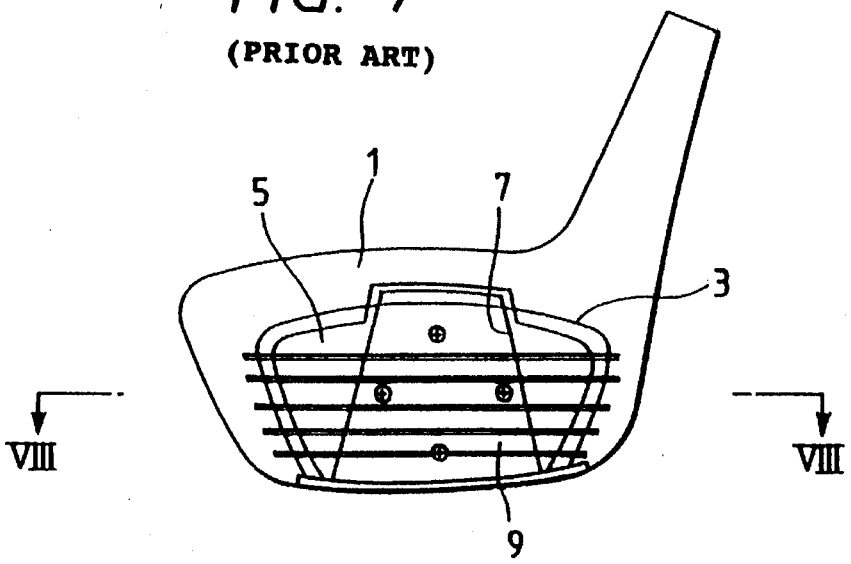
FIG. 7 (PRIOR ART)
FIG. 7 is a front view of a conventional golf club head.
Figure 8:
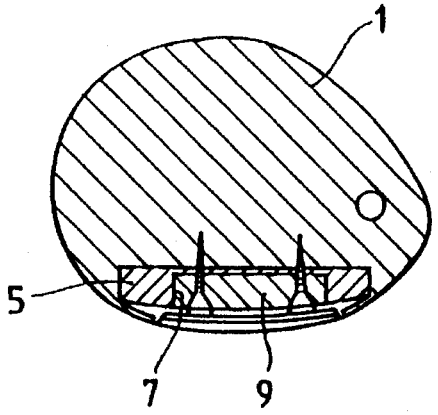
FIG. 8 (PRIOR ART)
FIG. 8 is a section view of the conventional golf club head, taken along the line VIII—VIII in FIG. 7; and, FIG. 9 is a partly cutaway plan view of the conventional golf club head.
Figure 9:
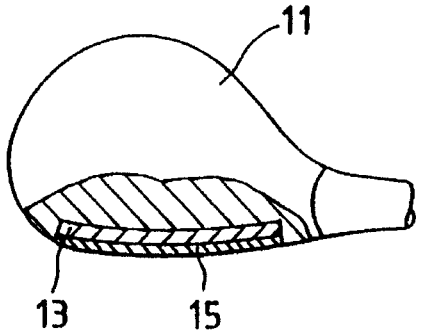
FIG. 9 (PRIOR ART)

FIGS. 5 and 6 show a third embodiment of a golf club head according to the invention. In the present embodiment, the invention is applied to a wood club head in place of the iron club heads respectively used in the first and second embodiments.

In order words, reference character 37 designates a head main body in which a filler 39 formed of foaming synthetic resin is covered with an outer shell 41 formed of stainless steel. The head main body 37 includes a face part 43 in which a recessed portion 45 having a shape identical with that of the face part 43 with the peripheral edge portion thereof left, In the recessed portion, there is mounted a face member 47 flush with the face part 43 and abutting the rear wall 45*a* defined by the recessed portion 45. The face member 47 is formed of a fiber reinforced synthetic resin material which is reinforced with a non-metallic fiber such as carbon, glass or the like and has high elasticity.

Also, in the face member 47 and, in more particular, in a recessed portion 54 formed in the face member 47, as shown in FIG. 6, there is mounted a protective layer 53 having a U-shaped section such that it covers the ball hitting surface side of the face member 47 from the top part 49 to the sole part 51 of the head main body 37. The protective layer 53 is mounted flush with the face part 43 and the ball hitting surface side of the face member 47 is in part exposed to the face part 43.

Accordingly, in the present embodiment as well, similarly to the above-mentioned first and second embodiments, the protective layer 53 is formed of the metal plate which is higher in hardness than the face member 47, is smaller in specific gravity than the head main body, and is smaller in thickness than the face member 47. The material thereof includes stainless steel, titanium, aluminum, beryllium, lithium, alloys of these metals and the like. Also, the protective layer 53 includes a plurality of score line grooves 55 in the surface thereof.

As described above, in the present embodiment as well, since the face member 47 formed of the fiber reinforced synthetic resin is provided at the face part 43 side of the head main body 37, the face part 43 side of the head main body 37 is light in weight and thus the gravity depth thereof is deep. Also, since the protective layer 53 is formed of the metal plate which is smaller in thickness than the face member 47, the restitution of the face member 47 cannot be impaired but the protective layer 53 can protect the ball hitting surface side of the face member 47 against shocks given when the ball is hit to thereby prevent the face member 47 from being worn.

Besides, since the protective layer 53 has specific gravity equal to or smaller than that of the head main body 37, the protective layer 53 can protect the face member 47 as well as can maintain the deep gravity depth of the head main body 37.

Therefore, if a ball is hit with a gold club including the golf club head according to the present embodiment, then the ball can be controlled easily due to the deep gravity depth, while the ball carry can be increased because of the high restitution of the face member 47 and the ball hitting feeling can be improved. Further, the face member 47 is prevented from wearing against shocks given when the ball is hit. Accordingly, the present embodiment can also attain the desired object of the invention similarly to the first and second embodiments.

Although the head main body 17, 37 is formed of stainless steel in the above-mentioned respective embodiments, the head main body may be formed of titanium or titanium alloy and, in this case, the protective layer may be formed of titanium, aluminum, beryllium, lithium, alloys of these metals, and the like.

Also, besides the fiber reinforced synthetic resin material which is reinforced with a non-metallic fiber and has high elasticity, as the material of the face member, there can be used a fiber reinforced synthetic resin material which is reinforced with a metal fiber and has high elasticity, a highly elastic synthetic resin material mixed with sic whisker or the like.

As has been described heretofore, according to the golf club head of the invention, wear of the ball hitting surface can be prevented without impairing the ball carry and ball hitting feeling.

What is claimed is:

1. A golf club head, comprising:

a head main body formed of metal, having a rear wall defining a cup-shaped recessed portion in a face part thereof;

a face member formed of highly elastic synthetic resin material, and mounted in said cup-shaped recessed portion; and a protective layer formed of a metal plate and disposed at a ball hitting surface side of said face member, wherein the protective layer is higher in hardness than said highly elastic synthetic resin material, is equal to or smaller than said head main body in specific gravity, and is smaller in thickness than said face member, and wherein said face member is thicker in section than said rear wall.

2. The golf club head according to claim 1, wherein a plurality of score line grooves are formed on a surface of said protective layer.

3. The golf club head according to claim 1, wherein said cup-shaped recessed portion is completely circumscribed by a periphery of said face part, and said protective layer is mounted in a second recess provided in said face member.

4. The golf club head according to claim 1, wherein a portion of said face member is exposed outside and flush with a periphery of said face part.

5. The golf club head according to claim 4, wherein said protective layer is circumscribed by said portion of said face member.

6. The golf club head according to claim 4, wherein said protective layer is flush with said periphery of said face part.

7. The golf club head according to claim 1, wherein said protective layer is in non-contact with said head main body.

8. The golf club head according to claim 1, wherein said protective layer permits both lateral end portions of said face member located opposite from each other with respect to said protective layer to be exposed outside.

9. The golf club head according to claim 1, wherein said protective layer is substantially U-shaped in section and mounted in said recessed portion to at least partially circumscribe said face member.

10. A golf club head comprising:

a head main body formed of metal, having a rear wall defining a recessed portion in a face part thereof;

a face member formed of highly elastic synthetic resin material, and mounted in said recessed portion; and a protective layer formed of a metal plate and disposed at a ball hitting surface side of said face member, wherein the protective layer is higher in hardness than said highly elastic synthetic resin material, is equal to or smaller than said head main body in specific gravity, and is smaller in thickness than said face member;

wherein said protective layer corresponds in shape to an open end of said recessed portion circumscribed by a periphery of said face part, and is mounted in said recessed portion so that said protective layer completely closes said open end.

* * * * *